United States Patent [19]

Veyrassat

[11] 3,952,960

[45] Apr. 27, 1976

[54] WINDING MACHINE EQUIPPED WITH A TRAVERSE MECHANISM

[75] Inventor: Louis Veyrassat, Rolle, Switzerland

[73] Assignee: Maillefer S.A., Switzerland

[22] Filed: Oct. 22, 1974

[21] Appl. No.: 517,024

[30] Foreign Application Priority Data

Oct. 26, 1973 Switzerland ..... 15104/73

[52] U.S. Cl. ..... 242/25 A

[51] Int. Cl.[2] ..... B65H 67/04

[58] Field of Search ..... 242/25 A, 25 R, 78 A, 242/18 R

[56] References Cited

UNITED STATES PATENTS

| | | | |
|---|---|---|---|
| 1,744,739 | 1/1930 | Blount | 242/25 R X |
| 1,964,530 | 6/1934 | Newton et al. | 242/25 R |
| 3,182,921 | 5/1965 | Nelson | 242/25 A |
| 3,661,335 | 5/1972 | Stefaniszyn | 242/25 A |

*Primary Examiner*—Stanley N. Gilreath

*Attorney, Agent, or Firm*—Stevens, Davis, Miller & Mosher

[57] ABSTRACT

A winding machine equipped with a traverse mechanism to protect, for example, a reel or wire wound on a reel should feed wire break during feeding of the reel. The mechanism includes a carriage, borne by a support, which moves back and forth along the entire length of a reel and carries a pulley for guiding wire that is wound on the reel. A circular protective channel coaxial with the reel and borne by the carriage moves back and forth with the carriage. The channel includes a circular track portion extending in a plane parallel to and laterally offset with respect to the plane of the pulley, and a deflection portion situated in the same plane as the pulley and limited by a deflection wall.

6 Claims, 7 Drawing Figures

WINDING MACHINE EQUIPPED WITH A TRAVERSE MECHANISM

This invention relates to a winding machine equipped with a traverse mechanism comprising a carriage, borne by a support, reciprocatingly movable along the entire length of a reel, and carrying a pulley for guiding wire being wound on the reel.

The production of insulated or bare metal wire of small diameter requires the use of winding machines operating at increasingly high speeds. Owing to such high speeds, the risk of breakage of the wire during the filling of a reel cannot be entirely eliminated, particularly with fine wire or wire made of low strength materials such as aluminum, for example. Thus if the wire breaks, the broken end whips about the reel and is liable to damage not only certain parts of the reel but also the layers of wire already wound.

It has hitherto been attempted to remedy these drawbacks by automatically detecting the breaking of the wire and then blocking the reel as quickly as possible. However, this method does not adequately remedy the drawbacks resulting from wire breakage.

It is the object of this invention to provide a means of avoiding as completely as possible the risk of damage to the reel and to the layers already wound in the event of the breakage of a wire being wound on a reel mounted on a winding machine.

To this end, in the winding machine according to the present invention, the carriage bears a circular protective channel coaxial with the reel.

The winding machine may be of any of the known types: a single-reel winding machine requiring the interruption of the wire-feed when the reel is full in order for it to be changed, a continuously operating winding machine comprising supports for two reels having either parallel axes or the same axis, or a winding machine having a rotary cage. All these types of winding machines have a traverse mechanism which ensures the regular distribution of the turns of wire side by side in each layer during the filling of the reel.

A preferred embodiment and a variation of the winding machine according to the invention will now be described in detail with reference to the accompanying drawings, in which.

Figure 1:
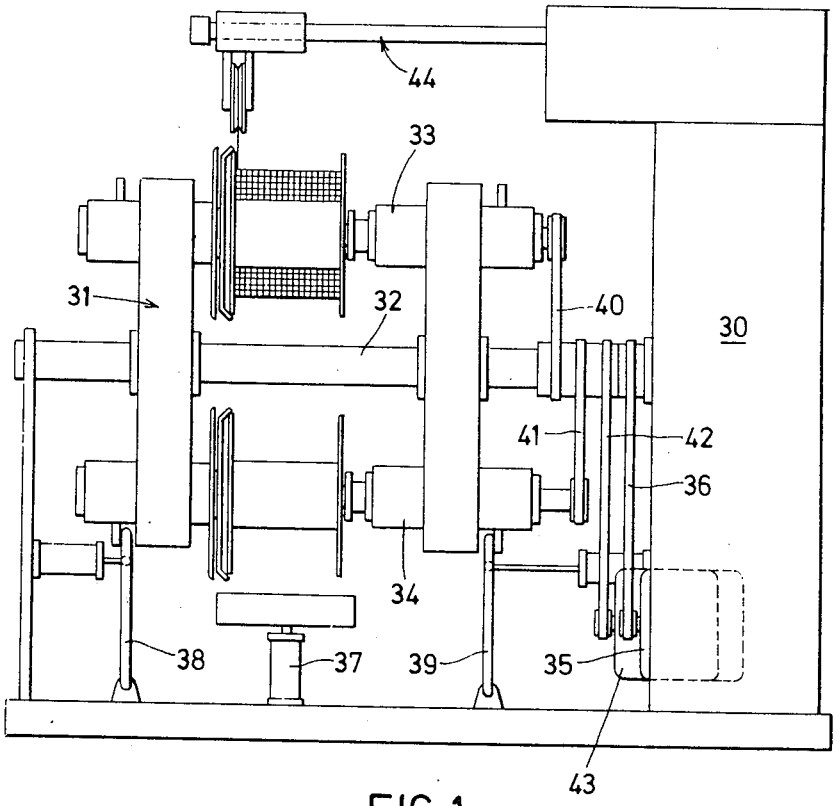
FIG. 1 is a simplified elevation of the winding machine.
Figure 2:
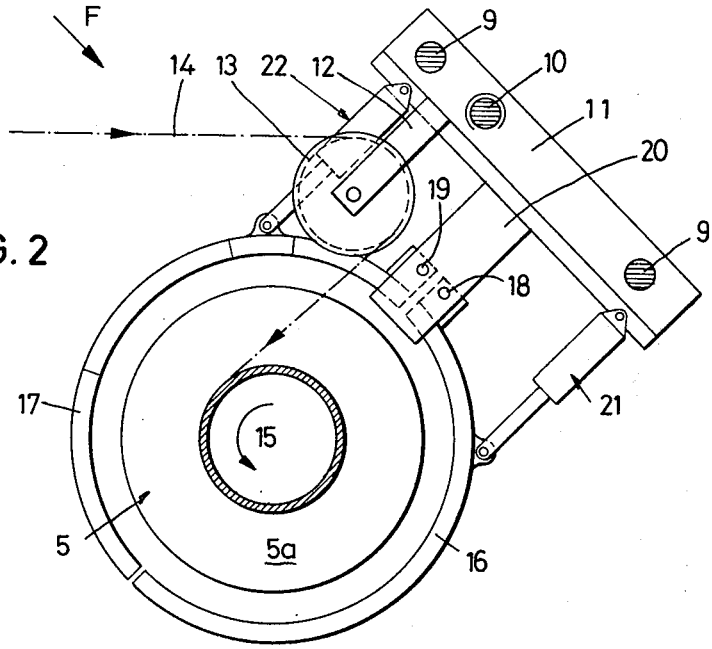
FIG. 2 is a partial section taken on the line II—II of FIG. 3.
Figure 3:
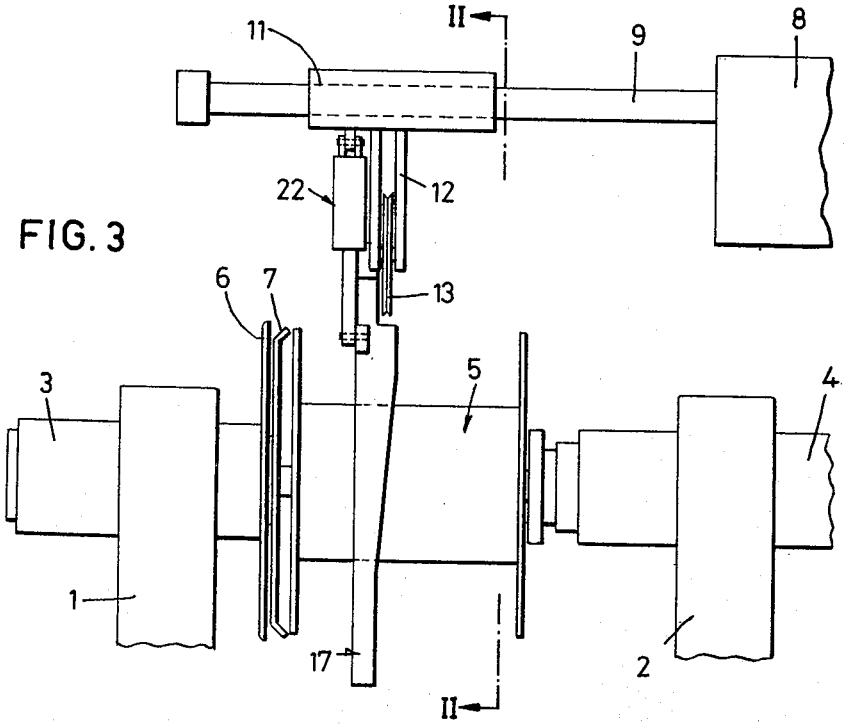
Figure 4:
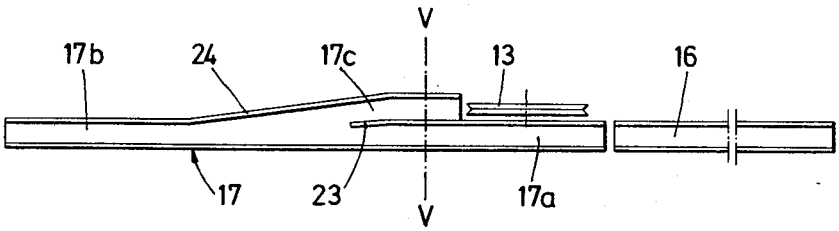
Figure 6:
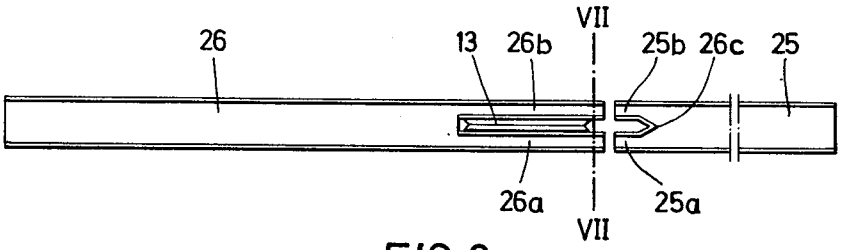
Figure 5:
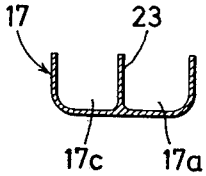
Figure 7:
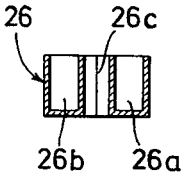

FIG. 3 is a partial elevation of the winding machine shown in FIG. 2, viewed in the direction of the arrow F, FIG. 4 is a developed view of the protective channel with which the winding machine shown in FIGS. 1–3 is equipped, FIG. 5 is a section taken on the line V—V of FIG. 4, FIG. 6 is a developed view of a protective channel constituting a variation of that shown in FIG. 4, and FIG. 7 is a section taken on the line VII—VII of FIG. 6.

A brief description will first be given of the winding machine on which the protective device is mounted. A rigid frame 30 (FIG. 1) bears a cage 31 comprising a shaft 32 pivoting on the frame 30. The cage 31 in turn bears two pairs of coaxial chucks 33 and 34 disposed in such a way that reels may be mounted between the two coaxial chucks of each pair. Belts 40, 41, and 42 and a motor 43 drive the reels in rotation via the driving chuck. A driving motor 35, connected to the shaft 32 by a belt 36, causes the cage 31 to rotate by 180° about its axis each time the reel situated at the top of the cage 31 reaches its final stage of winding. After the rotation of the cage 31, the full reel which is now situated at the bottom of the cage 31 is discharged onto a lift 37 after retraction of the chucks by means of control devices 38 and 39. The full reel is then taken away and replaced by an empty reel. A traverse mechanism 44, which will be described in more detail further on, guides the wire wound on the upper reel so as to distribute it in uniform layers.

FIG. 3 shows a portion of the cage 31 with two supporting arms 1 and 2 bearing chucks 3 and 4 between which a reel 5 is mounted. The chuck 4 is connected to the rotational drive mechanism, making it possible to rotate the reel 5 about its axis, and the chuck 3 is axially movable so that it may be pulled away from the flange of the reel 5 when the reel 5 is to be inserted and extracted. The chuck 3 is provided with a protective plate 6 and a disc having hooks 7 at its periphery. The hooks 7 automatically seize the wire whenever the winding is transferred from the full reel to an empty one so that the transfer may take place automatically.

The traverse mechanism comprises a support 8, two parallel guide bars 9 integral with the support 8, a screw 10 rotated by a motor accommodated in the support 8, and a carriage 11 which, as may be seen in FIG. 2, is guided on the bars 9 and driven by the screw 10 so that it reciprocates parallel to the axis of the reel 5 along the entire length of the reel 5. A stirrup-piece 12, integral with the carriage 11, bears a pulley 13 which pivots about an axis parallel to that of the reel 5. The pulley 13 guides a wire 14 coming from a production line. After having passed through the groove of the pulley 13, the wire 14 is wound on the drum of the reel 5, which is rotatingly driven in the direction indicated by an arrow 15.

The traversing carriage 11 also carries a protective channel composed of two semicircular elements 16 and 17. These elements are hinged about pins 18 and 19 to a bracket 20 integral with the carriage 11. In addition, each of them is connected to the carriage 11 by one of two jacks 21 and 22, the bodies of which are hinged to the carriage 11 and the shanks of which are hinged to the elements 16 and 17. The jacks 21 and 22 enable the channel elements 16 and 17 to be moved about their hinges between an open position, in which the reel 5 is completely disengaged from them, and a closed position, shown in the drawing, in which the two ends of the elements 16 and 17 meet so that the reel 5 is completely surrounded by the protective channel. As may be seen in FIG. 2, the channel elements 16 and 17 describe arcs of a circle having a greater diameter than that of the flange 5*a* of the reel 5, so that when the traversing carriage 11 reaches the end of its run, the elements 16 and 17 can become engaged about the plate 6 and the hooks 7. The shape of the channel consisting of the two elements 16 and 17 is illustrated in FIGS. 4 and 5. The element 16 is a simple U-sectioned metal sheet which extends along a 180° arc of a circle and is open at each end. The element 17, which likewise extends along a 180° arc of a circle, comprises U-sectioned portions 17*a* and 17*b*, similar to the element 16, at each of its ends; but its middle portion is provided with a deflection zone 17*c* adjacent to the continuation of the portion 17*a*. The deflection zone 17*c* is separated from the rest of the element 17 by a partition 23 formed by the continuation of one of the sidewalls of the portion 17*a*. The sidewall of the deflection zone 17*c* takes the form of a deflection wall 24 which is parallel to the partition 23 at the entrance to the zone 17*c* and then runs at a slant so as to merge with the sidewall of the portion 17*b* lying in the same plane as the sidewall of which partition 23 is a continuation. As may be seen in FIG. 3, the portions 17*a*, 17*b*, and the entirety of the channel element 16 are continuations of one another which thus form a continuous circular track, the contour of which is contained in a plane perpendicular to the axis of the reel 5 and to the axis of the pulley 13. This plane is laterally offset with respect to that of the pulley 13. The entrance to the deflection zone 17*c* is situated immediately after the pulley 13.

FIGS. 6 and 7 illustrate another embodiment of the protective channel. This second embodiment is composed of two channel elements 25 and 26 intended to be mounted on the bracket 20 and controlled by the jacks 21 and 22 exactly like the elements 16 and 17. Each of them has a U-shaped profile, but this profile is wider than that of the element 16 and the portions 17*a* and 17*b*. Each channel element 25 and 26 has near its hinged end a slot bounded by two partition elements, 25*a*, 25*b* and 26*a*, 26*b*, respectively, as shown in FIG. 7. The slot in the channel element 26 is longer than that of the channel element 25, the latter slot being limited towards the front by two oblique partition elements 26*c* which meet to form a deflection partition for the end of the wire. The slot in the element 26 is long enough to admit the pulley 13.

The circular channel which completely surrounds the reel 5 prevents the wire from being damaged in the event of breakage during winding. It will be clear from FIG. 2 that the wire-tail, after having passed over the pulley 13, will have the tendency, under the effect of centrifugal force, to lie pressed against the bottom of the channel. If the channel is designed as shown in FIG. 4, the wire-tail will be picked up by the entry zone 17*c*. It will tend to describe a circular path contained in the plane of the pulley 13 but will be deflected by the wall 24 and will arrive in the circular track delimited by the portion 17*b* of the element 17, then by the element 16, and then by the portion 17*a* of the element 17. Thus as soon as it has been picked up by the deflection zone 17*c*, the wire-tail is guided into the circular track of the channel and remains there.

Exactly the same applies to the embodiment according to FIGS. 6 and 7. After the wire-tail has passed over the pulley 13, it is picked up by the channel element 26 and follows down the middle of that element. It then passes down the middle of the element 25 until it is deflected to one side or the other by the partition 26*c*. From then on, it follows one of the continuous circular tracks situated on each side of the plane of the pulley 13.

Whenever the reel 5 is full and the wire is transferred to another reel, the jacks 21 and 22 are manipulated so as to open the protective channel and free the reel.

In order to operate properly, the winding machine described should be equipped with a device for detecting wire breakage. Devices of this kind are well known. They may, for example, comprise a pulley mounted on a lever acted upon by a spring, the pulley and the lever normally being held in a position where the spring is tensed by the pull which the wire exerts upon the pulley. This pulley may be situated just before the pulley 13, for example. As soon as the wire breaks, it no longer exerts any pull, and the lever pivots under the influence of the spring. It may be equipped with a contact which opens or closes when it moves, thus transmitting a signal through an electric circuit. This signal will serve to control the motor driving the carriage 11 and will cause the carriage to stop immediately whenever the wire breaks. Under these circumstances, the broken end of the wire will follow the circular track of the protective channel, without hitting against anything and without lashing against the turns of wire already wound, until the reel has been stopped.

What is claimed is:

1. A winding machine equipped with a traverse mechanism comprising a carriage borne by a support, said carriage being reciprocatingly movable along the entire length of a reel and carrying a pulley for guiding wire being wound on said reel, a circular protective channel coaxial with said reel and borne by said carriage so as to move reciprocatingly with said carriage, said channel including at least one circular track portion extending in a plane parallel to and laterally offset with respect to that of the pulley, and a deflection portion situated in the same plane as the pulley and limited by a deflection wall.

2. A winding machine according to claim 1, wherein said channel comprises a single circular track portion limited by two parallel side walls and an entrance portion situated immediately after the pulley and limited by said deflection wall, said deflection wall extending obliquely and merging with one of said side walls.

3. A winding machine according to claim 2, wherein said single circular track portion and said entrance portion are adjacent to each other.

4. A winding machine according to claim 1, wherein said channel comprises a pair of circular track portions running on both sides of the plane of said pulley, and parallel to said pulley plane, and a center slot between said pair of track portions, said slot being long enough for admitting said pulley, and said deflection wall bounding said center slot at one end thereof, opposite said pulley.

5. A winding machine in accordance with claim 1, wherein said protective channel is formed of two semicircular elements mounted on said carriage and adapted to pivot about axes parallel to that of said reel between a disengaged position in which said reel is free and an engaged position in which the ends of said elements meet.

6. A winding machine in accordance with claim 5, wherein said elements are controlled by jacks, the bodies of which are mounted on said carriage.

* * * * *